US005422796A

United States Patent [19]

Peebles et al.

[11] Patent Number: 5,422,796

[45] Date of Patent: Jun. 6, 1995

[54] LIGHT TWIRLER WAND

[76] Inventors: Sheon J. Peebles; Gary N. Peebles, both of P.O. Box 418, Amity, Oreg. 97101

[21] Appl. No.: 169,418

[22] Filed: Dec. 20, 1993

[51] Int. Cl.[6] ..... A45B 3/02

[52] U.S. Cl. ..... 362/102; 362/35; 362/109; 362/386; 446/485; 446/242

[58] Field of Search ..... 362/35, 102, 109, 184, 362/190, 191, 269, 272, 286, 386; 446/485, 236, 242, 266; 84/477 B

[56] References Cited

U.S. PATENT DOCUMENTS 2,135,606 11/1938 Sture ..... 446/236
2,214,392 9/1940 Whipple ..... 362/109
4,996,633 2/1991 Fu ..... 362/35
5,041,947 8/1991 Yuen et al. ..... 362/287
5,190,491 3/1993 Connelly ..... 446/242
5,269,719 12/1993 Klawitter et al. ..... 446/242

*Primary Examiner*—Ira S. Lazarus
*Assistant Examiner*—Y. Quach

[57] ABSTRACT

A light twirler wand including a central portion held in the hand and furthermore containing batteries, motors, switches and an electrical power transfer device; and a series of rotating lighted arms at one or both ends of the central portion. Lights affixed to the arms may be positioned at the tips or a plurality of lights may be dispersed throughout the arm to produce a desirable lighting effect.

3 Claims, 4 Drawing Sheets

LIGHT TWIRLER WAND

BACKGROUND OF THE INVENTION

1. Field of the Invention

The present invention relates to hand held lighting devices and more particularly pertains to a hand held, battery operated, kinematic optical emitter which may be utilized for entertainment, attracting attention, and general novelty lighting applications.

2. Description of the Prior Art

The use of hand held lighted wands and kinematic display lighting is known in the prior art. More specifically, hand held lighted wands heretofore devised and utilized for the purpose of entertainment and attracting attention are known to consist basically of familiar, expected and obvious structural configurations, notwithstanding the myriad of designs encompassed by the crowded prior art which have been developed for the fulfillment of countless objectives and requirements.

For example, in U.S. Pat. No. 4,924,358 to Von Heck a safety-sparkler wand with chemiluminescent or electric-light illumination is disclosed. The Von Heck invention comprises a hand held intrinsically lighted wand having a multiplicity of highly flexible optical fiber strands conveying light from an electrically or chemically stimulated internal source to various conically enveloped volumes wherein the emergent light proceeds into free space with a given optical fiber termination as an apex. Movement of the device holding hand stimulates movement of the optical fibers and, consequently, viewers perceiving the light emitted from the fibers observe a random blinking or sparkling effect. The present invention differs markedly in having one or more electric motors powering a plurality of light emitters which are substantially fixed in position on a series of radially disposed arms. The light sources move in a substantially circular path thereby generating an effect in hand held wand light sources far removed from the capabilities of the Von Heck patent.

In U.S. Pat. No. 5,097,394 to Friedlander a dynamic light sculpture wherein an externally illuminated, elongated, flexible element is driven in multidimensional motion by one or more electric motors is described. The various oscillations, nodal formations, and occasional chaotic behavior of the illuminated flexible element are observable and are purportedly pleasing in effect. The present invention differs from the Friedlander patent in employing a plurality of kinematic illumination sources wherein each illumination source is rigidly affixed to a stiff radial member extending from a motor driven central hub. The Friedlander invention is not readily adaptable to battery power and is unsuitable for a hand held wand configuration.

In U.S. Pat. No. 5,041,947 to Yuen et al. a display device is disclosed wherein a plurality of light sources arranged in a pattern are rotated by two rotating means in one or more planes to achieve unique optical effects. The Yuen et al. invention has no provision for single axis rotation of a radially arranged array of lights as in the present invention and is not disclosed having an embodiment which is adaptable to a hand held, battery powered, kinematic light apparatus.

In U.S. Pat. No. 4,364,106 to Lama light display with travelling balls and compound rotation is disclosed. The Lam invention comprises a rigid assembly of hollow tubes rotated simultaneously about horizontal and vertical axes, wherein each tube contains a free ball illuminated from below by an external light source. The present invention differs from the Lam invention in having moving sources of light and thereby being independent of reflected light and the complexities introduced by having an external light source. Additionally, the Lam patent omits any hand held or wandlike configuration and is not renderable to forms amenable to holding in ones hand.

In U.S. Pat. No. 3,916,181 to Smith an illuminated propeller decorative light is disclosed wherein a battery powered light source is coupled through a series of small apertures to a multiplicity of transparent propeller blades fixedly attached to a freely spinning hub. The propeller assembly is caused to spin by external influence and light is emitted whenever the apertures are in alignment with the base of a propeller blade. The present invention employs internal electric motors to drive the moving parts which include a series of light sources.

In U.S. Pat. Nos. 4,097,917 and 4,206,495 to McCaslin a rotatable light display is described in which a tube containing a multiplicity of flexible, rod like, light transmitting members illuminated from below is caused to rotate about a central axis in response to sound input. The present invention differs in providing motion to a multiplicity of light sources and in being hand held.

In U.S. Pat. No. 4,600,973 to Mori a light source device is disclosed for the purpose of stimulating photosynthesis in plants. The Mori patent comprises an optical fiber or optical fiber bundle coupled to a light source. An electric motor engages a crank which provides oscillatory motion of a portion of the optical fiber such that the light emerging from the optical fiber is caused to sweep a large area. A disadvantage in this prior art lies in a lack of movement of a light source, the absence of battery power, and the inability to extend to a wandlike configuration.

As illustrated by the background art, efforts are continuously being made to attempt to improve kinematic light sources. No prior effort, however, provides the benefits attendant with the present invention. Additionally, the prior patents and commercial techniques do not suggest the present inventive combination of component elements arranged and configured as disclosed and claimed herein.

Therefore, it can be appreciated that there exists a continuing need for a light twirler wand which can be employed to provide a dramatic hand held kinematic display of light. In this regard, the present invention substantially fulfills this need.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types now present in the prior art, the present invention provides an improved hand held kinematic light wand construction wherein the same can be utilized for entertainment, attracting attention, or for communications. As such, the general purpose of the present invention, which will be described subsequently in greater detail, is to provide a new and improved hand held kinematic light source apparatus and method which has all of the advantages of the prior art hand held kinematic lighting methods and none of the disadvantages.

The invention is defined by the appended claims with the specific embodiment shown in the attached drawings. For the purpose of summarizing the invention, the invention may be incorporated into a tubular wand first portion containing an electric battery power source, switches, and motors; a second portion comprising radially disposed arrays of electric light sources engaging the drive section of a motor in the first portion; and a third portion being a substantial mirror image of the second portion. The tubular wand first portion is held in the human hand and the second and third portions may be caused to spin and emit light thereby creating an unusual visual effect especially if the human holder gyrates or otherwise moves the entire assembly as in twirling a baton.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention may be better understood so that the present contribution to the art can be more fully appreciated. Additional features of the invention will be described hereinafter which form the subject of the claims of the invention. It should be appreciated by those skilled in the art that the conception and the disclosed specific methods and structures may readily be utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved light twirler wand.

It is another object of the present invention to provide a new and improved light twirler wand which may be easily and efficiently manufactured and marketed.

It is a further object of the present invention to provide a new and improved light twirler wand which is of a durable and reliable construction.

An even further object of the present invention is to provide a new and improved light twirler wand which is susceptible of a low cost of manufacture with regard to both materials and labor, and which accordingly is then susceptible of low prices of sale to the consuming public, thereby making such light twirler wand economically available to the buying public.

Still yet another object of the present invention is to provide a new and improved light twirler wand which provides in the apparatuses and methods of the prior art some of the advantages thereof, while simultaneously overcoming some of the disadvantages normally associated therewith.

Still another object of the present invention is to provide a new and improved light twirler wand which serves a purpose of providing an entertaining optical display.

Yet another object of the present invention is to provide a new and improved light twirler wand which incorporates a self contained kinematic power source which facilitates production of a continuous optical display of long duration thereby providing the user with enhanced attention capture capabilities.

Even still another object of the present invention is to provide a new and improved light twirler wand thereby having a beneficial impact on the kinematic optical display industry in general.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding may be had by referring to the summary of the invention and the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
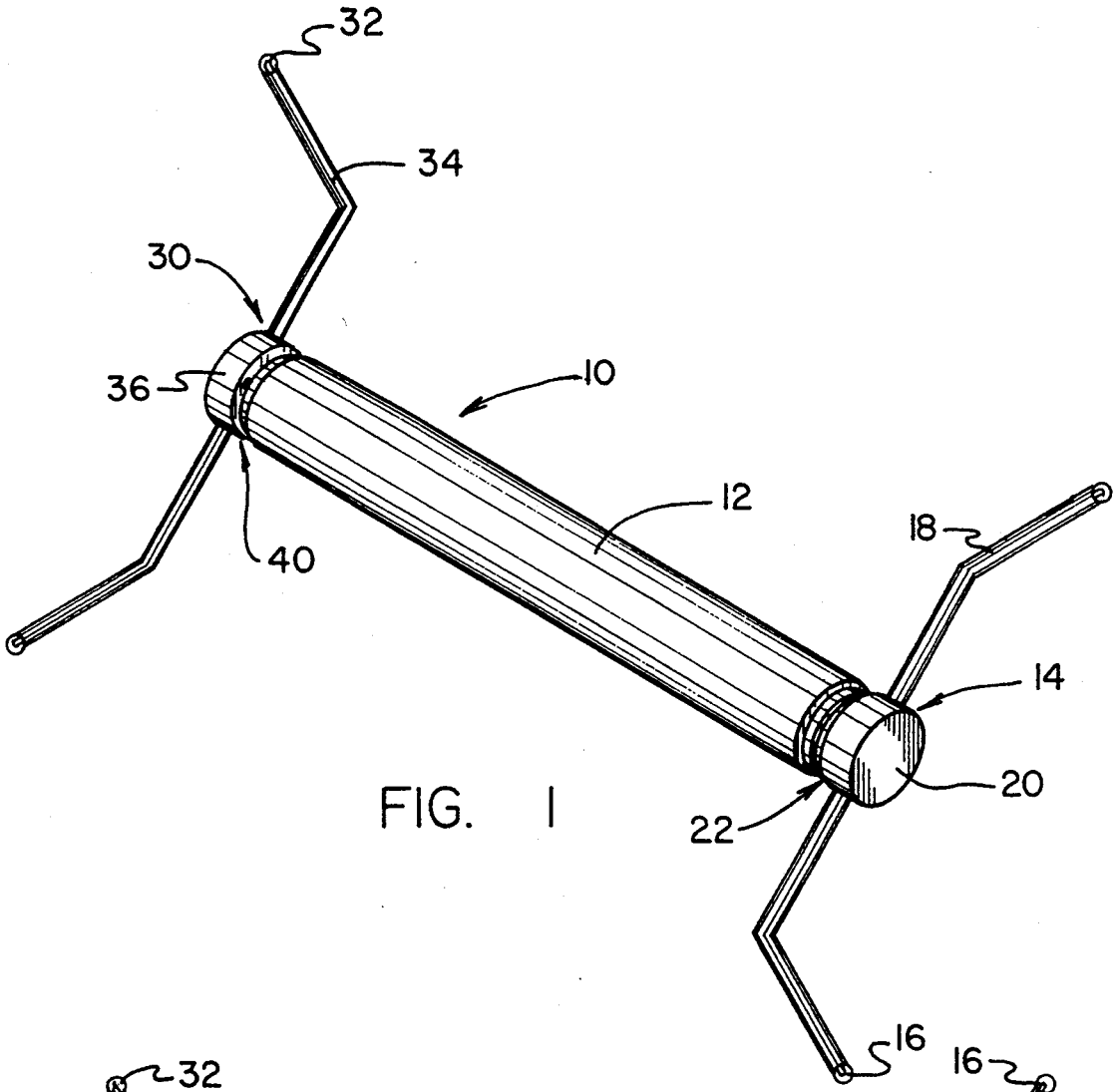
FIG. 1 is a perspective view of a light twirler wand.

With reference now to the drawings, and in particular to FIG. 1 thereof, a new and improved light twirler wand embodying the principles and concepts of the present invention and generally designated by the reference numeral 10 will be described.

Figure 2:
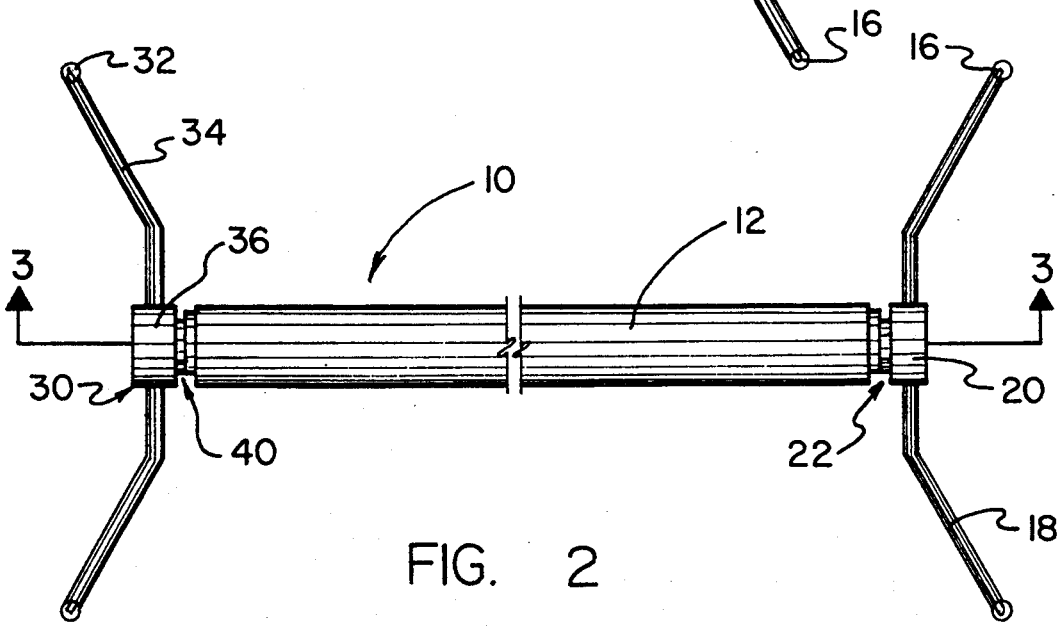
FIG. 2 is a side elevational view of the light twirler wand.

From an overview standpoint, the light twirler wand 10 is adapted for use by a human to attract attention and generally have an entertaining effect. Light twirler wand 10 comprises a first portion 12 which houses stored energy and engine components, and a rotatably driven second portion 14 having a multiplicity of electric lights 16 mounted on arms 18 converging to a hub 20 wherein hub 20 provides rigid support for an end of each arm 18 and additionally comprises a portion of a co-active rotary electrical transfer device 22, and a rotatable third portion 30 presenting, more or less, a mirror image of second portion 14 by having a multiplicity of electric lights 32 mounted on arms 34 converging to a hub 36 wherein hub 36 provides rigid support for an end of each arm 34 and additionally comprises a portion of a co-active rotary electrical transfer device 40. See FIGS. 1 and 2.

Figure 3:
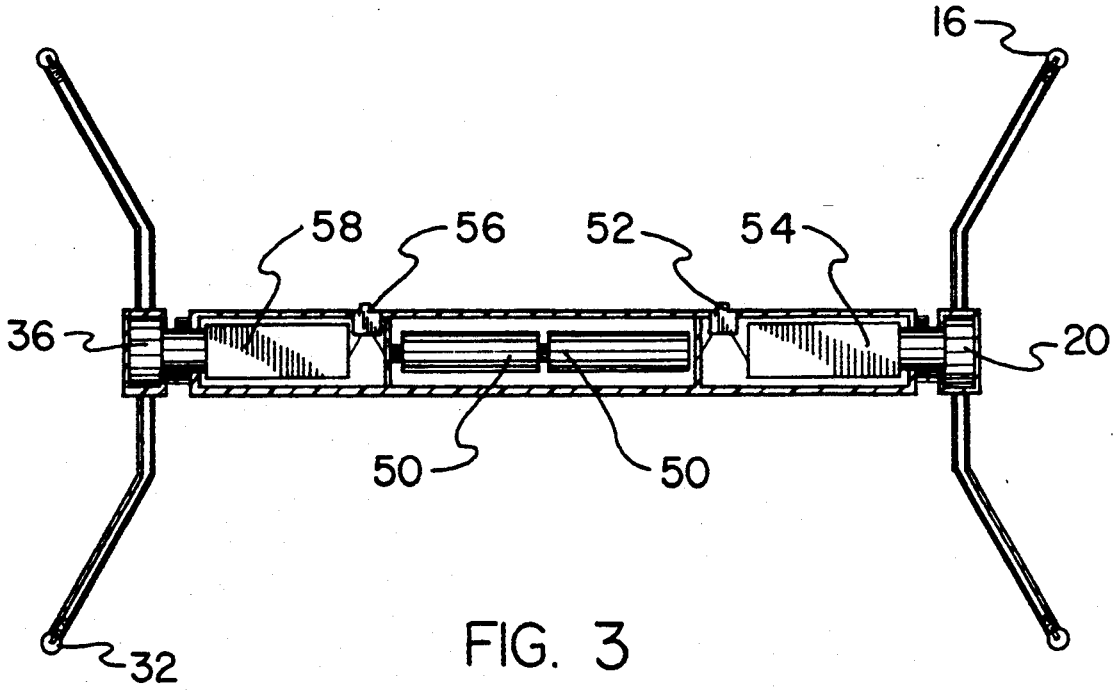
FIG. 3 is a side sectional view of the light twirler wand taken substantially upon the plane indicated by the section lines 3—3 of FIG. 2.

More specifically, it will be noted that the light twirler wand 10 first portion 12 comprises an elongate tubular structure and may be composed of various rigid structural materials such as aluminum or plastic, and furthermore may include various surface treatments such as texturing, ribbing, printing, and color schemes. First portion 12 houses one or more electrical batteries 50 which may comprise disposable dry electrochemical cells, rechargeable electrochemical cells, or any electric current producing cell which is self contained and has an ability to supply adequate power for all light twirler wand functions for extended periods. See FIG. 3.

Figure 4:
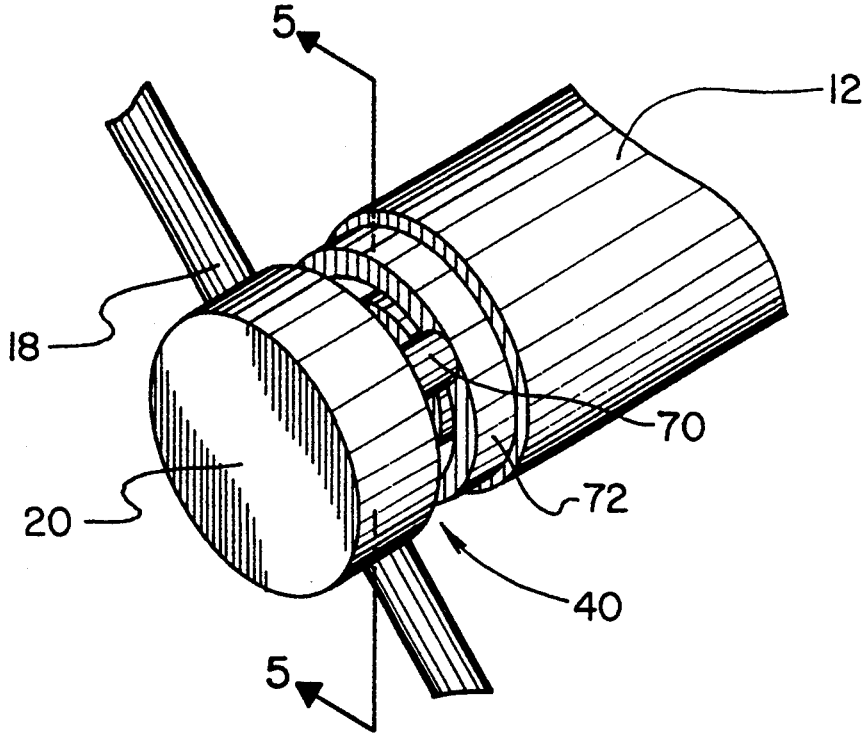
FIG. 4 is fragmentary perspective view of the light twirler wand.
Figure 5:
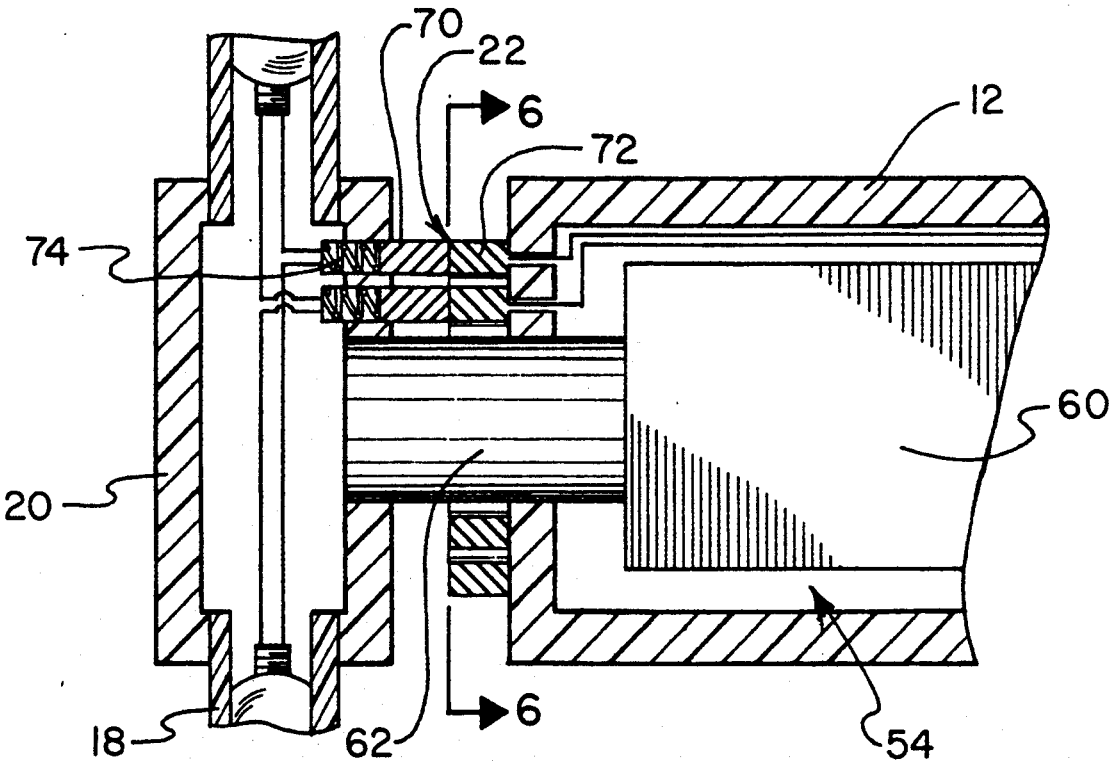
FIG. 5 is a fragmentary sectional view of the light twirler wand taken substantially upon the plane indicated by the section line 5—5 of FIG. 4.

Electrical batteries 50 are disposed in a series conductive arrangement with switch 52, lights 16, and electric motor 54, and in a separate series conductive arrangement with switch 56, lights 32, and electric motor 58. Alternately, a single switch may be used to control a parallel arrangement of lights 16 and 32, and electric motors 54 and 58. See FIGS. 4 and 5.

Electric motor 54 comprises body 60 and extended shaft 62 wherein hub 20 engages shaft 62 such that hub 20 and shaft 62 rotate as a unit under the influence of the various internal devices of electric motor 54. Electrical power is transferred from batteries 50 to lights 16 by co-active rotary electrical transfer device 22 wherein brushes 70 are maintained in contact with collector rings 72 by springs 74.

Figure 6:
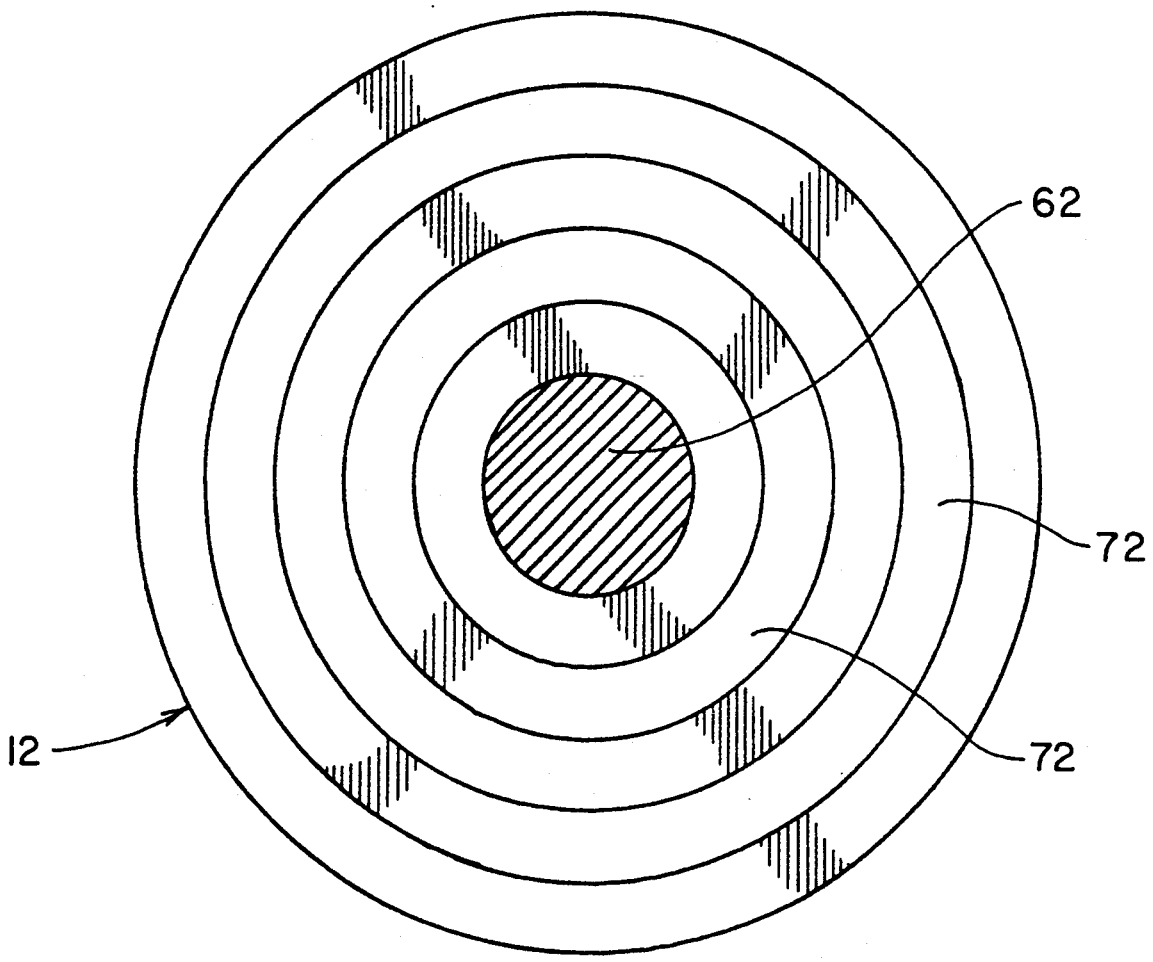
FIG. 6 is a sectional side view of electrically conductive collector rings attached to the first portion of a light twirler wand.
Figure 8:
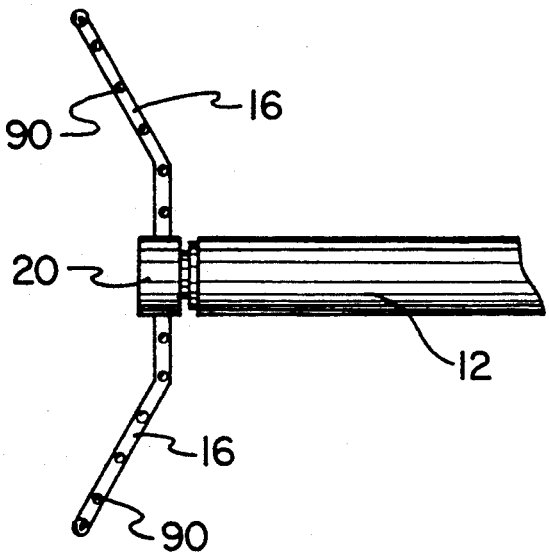
FIG. 8 is a fragmentary front elevational view of an alternate embodiment of the light twirler wand.

FIG. 6 shows a concentric arrangement of two collector rings 72 affixed to motor shaft 62, however, a conductive motor shaft 62, motor housing, and motor bearing can be employed as a substitute for one collector ring. Brushes 70 are shown affixed to hub 20 and collector rings 72 are affixed to first portion 12, however, an alternate arrangement in which brushes 70 are affixed to first portion 12 and collector rings are affixed to hub 20.

Electric motor 58 equivalently comprises a body and extended shaft wherein hub 36 engages the extended shaft such that hub 36 and the extended shaft rotate as a unit under the influence of the various internal devices of electric motor 58. Electrical power is transferred from batteries 50 to lights 32 by co-active rotary electrical transfer device 40 wherein brushes are maintained in contact with collector rings by springs. The brushes may be affixed to hub 36 and collector rings 72 may be affixed to first portion 12, however, an alternate arrangement is feasible wherein the brushes are affixed to first portion 12 and collector rings 72 are affixed to hub 36.

Figure 7:
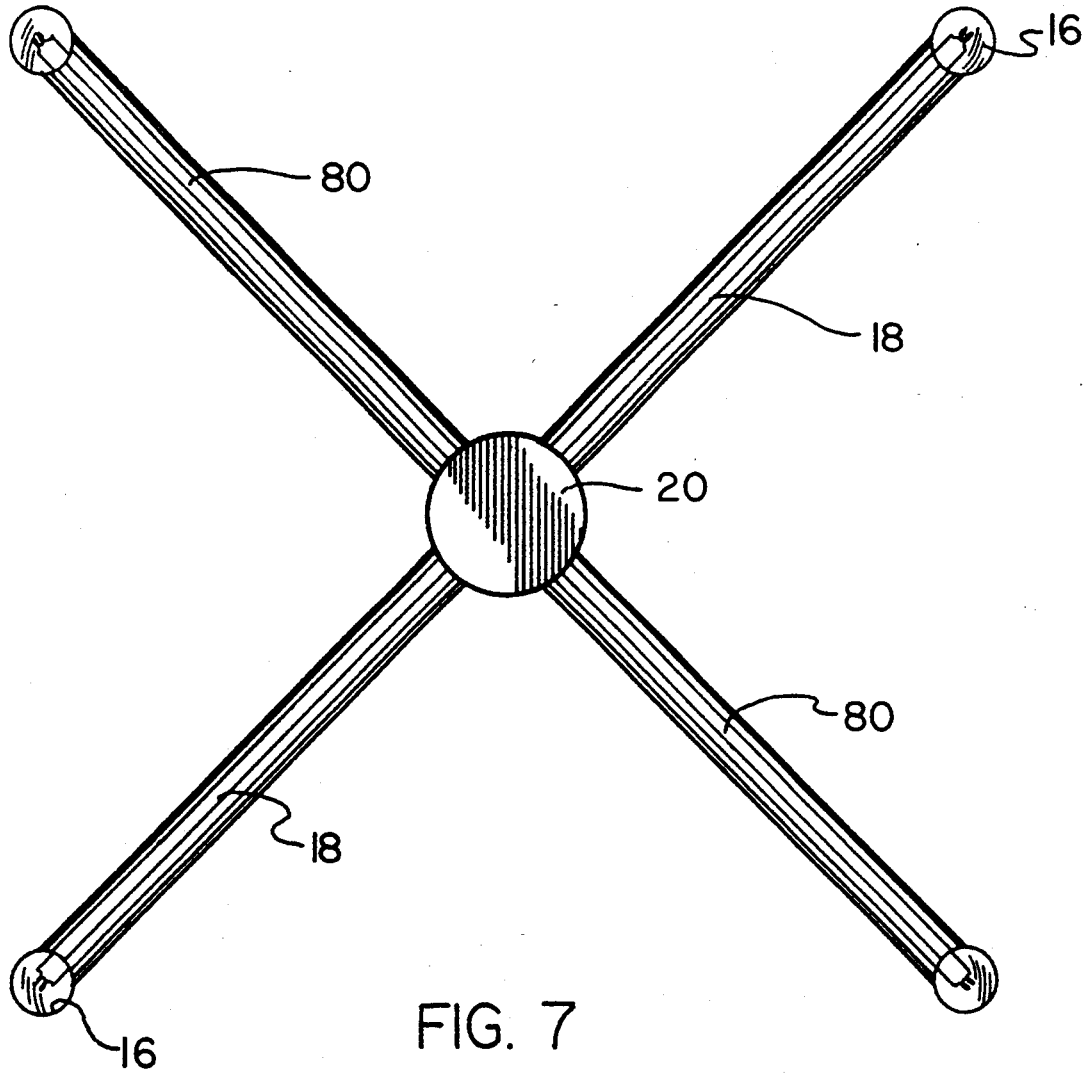
FIG. 7 is a front elevational view light twirler wand.

In an alternate embodiment additional arms 80 and optical emitters 16 are affixed to hub 20. See FIG. 7. And furthermore, the length of arms 80 may differ substantially from the length of arms 18. Likewise the assembly comprising arms 34, optical emitters 32, and hub 36 may be modified by inclusion of arms 80.

In another alternate embodiment a plurality of optical emitters 90 are affixed to arms 18, arms 80, and arms 34.

Additionally the light twirler wand may feature only first portion 12 and second portion 14 wherein first portion 12 comprises a housing containing a single motor 54 and switch 52.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A new and improved light twirler wand for attracting attention and providing entertainment comprising:

a tubular first portion said wand housing an internal electrical power source, two electric motors, electrical power transfer means and electrical switching means;

a second portion coupled with respect to the first portion at one end comprising a plurality of arms radially joined at a common first hub having an electrical power transfer means wherein said first hub engages an extended portion of a driven shaft member of one of the motors of the first portion, and furthermore said arms comprise elongated members to which optical emitters are affixed; and a third portion coupled with respect to the first portion at the other end comprising a plurality of arms joined at a common second hub having an electrical power transfer means wherein said second hub engages an extended portion of a driven shaft member of the remaining electric motor of the first portion, and furthermore said arms comprise elongated members to which a plurality of optical emitters are affixed, said electrical power transfer means comprising a first coacting member formed as a series of coacting electrically conductive brushes, and a second coacting member is coacting collector rings wherein one of the first and second coacting member is affixed to the hub member and another one of the complementary first and second coacting member is affixed to said first portion.

2. The new and improved light twirler wand of claim 1 in which said optical emitter is singularly affixed to a free end of each arm.

3. The new and improved light twirler wand of claim 1 wherein a multiplicity of said optical emitters are disposed at various sites along each arm.

* * * * *